US006179621B1

(12) United States Patent
Vaccari

(10) Patent No.: US 6,179,621 B1
(45) Date of Patent: Jan. 30, 2001

(54) PRAYER STRAND MARKER

(76) Inventor: Cathy Vaccari, 4059 El Segundo, Las Vegas, NV (US) 89121

( * ) Notice: Under 35 U.S.C. 154(b), the term of this patent shall be extended for 0 days.

(21) Appl. No.: 09/400,347

(22) Filed: Sep. 20, 1999

(51) Int. Cl.[7] ..... A44C 23/00
(52) U.S. Cl. ..... 434/246; 434/245
(58) Field of Search ..... 434/245, 246; 116/28 R

(56) References Cited

U.S. PATENT DOCUMENTS 2,519,819 * 8/1950 Brennan ..... 434/245
2,937,459 * 5/1960 Belfield ..... 434/246
3,319,599 * 5/1967 Kussman ..... 434/246
4,365,246 * 12/1982 Dewolf et al. ..... 434/246
5,349,920 * 9/1994 Koizumi et al. ..... 116/28 R

* cited by examiner

*Primary Examiner*—Sam Rimell
(74) *Attorney, Agent, or Firm*—Robert Ryan Morishita; Anderson & Morishita

(57) ABSTRACT

A device for marking a position on a prayer strand used to count prayers. The device includes a marker which is visually and tactually distinguishable from the nodes on the prayer strand and a clip for engaging the marker to the prayer strand. One embodiment of the device may include a tether attached to the marker to allow a user to readily find the marker and clip. Yet another embodiment of the device may further include a clasp attached to the tether so that the tether may be engaged to the prayer strand.

6 Claims, 4 Drawing Sheets

PRAYER STRAND MARKER

FIELD OF THE INVENTION

The present invention pertains to a prayer strands having a plurality of nodes positioned on a cord used to count prayers. Specifically, the present invention is a device for marking a user's position on a prayer strand for later reference.

BACKGROUND OF THE INVENTION

Many cultures and religions use prayer strands for counting and tracking prayers. The most well known of these devices is the strand of rosary beads used during the recitation of the rosary in the Catholic religion. However, many other religions, including the Hindu, Buddhist, Muslim, and Eastern Orthodox religions, use similar devices which have nodes, such as beads or knots, positioned on a cord to count or otherwise track a series of prayers as the prayers are recited.

In its simplest form, a user moves his or her fingers from node to node along the prayer strand as each repetition of the prayer is completed. In its more complex form, beads of different attributes, such as size, shape, or the like, prompt the user to recite different prayers in sequence.

Often, as a user recites the prayers, he or she may be interrupted. When such an interruption takes place, the user either risks losing his or her place along the prayer strand or must pinch the prayer strand between the user's fingers to try to maintain the user's position.

However, the drawback of this system is that the user may have difficulty recalling the direction in which the user was traversing the prayer strand when interrupted. Moreover, if the user is physically disabled or visually impaired, it may be difficult to maintain the user's place along the prayer strand because the user may be unable to firmly hold the prayer strand at the desired location for a long period of time.

Therefore, there is a need in the art for a device which marks a user's position on a prayer strand for later reference, without the user having to hold the marker in place.

SUMMARY OF THE INVENTION

A device for marking a position on a beaded or knotted prayer strand includes a marker and a clip attached to, or integrally formed with, the marker to secure the marker to the prayer strand. The marker is visually and tactually distinguishable from the beads or knots so that the user may find the marker by sight or touch alone. The clip preferably has a closed position, in which the clip engages the prayer strand or a node located thereon, and an open position, in which the clip may be removed from the prayer strand. In a preferred embodiment, the clip includes a spring to bias the clip into the closed position.

The marker may include a tether, preferably a flexible tether, connected to the clip. The tether allows the user to easily find and grip the marker.

Additionally, the end of the tether may include a clasp adapted to engage said strand. Thus, the clasp may be engaged to the strand to secure the marker to the strand. Also, the location of the clasp may serve to indicate the direction that the user was traversing the prayer strand when the clip was applied. Specifically, the clasp may be connected to one side of the starting node to indicate the direction in which the user was traversing the prayer strand.

It is an object of the present invention to provide a device which preserves, for later reference, a user's position along a prayer strand with a tactually and visually perceptible marker.

DESCRIPTION

Figure 1:
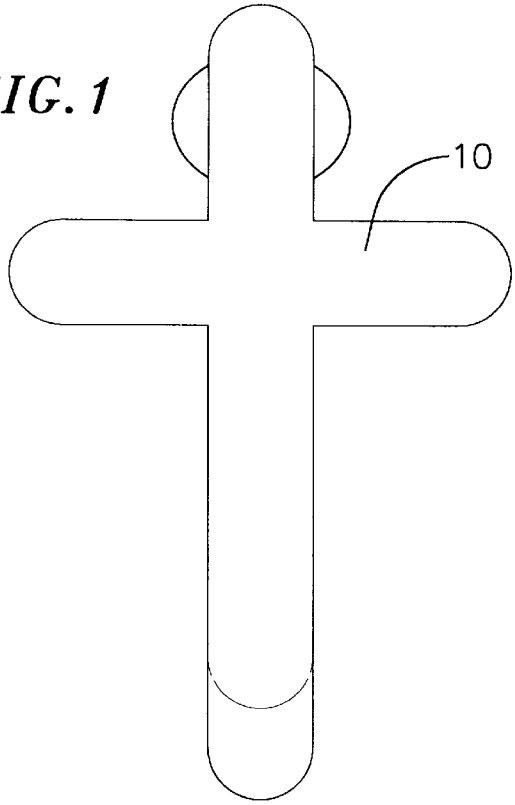
FIG. 1 is a front view of the marker and clip according to an embodiment of the present invention.
Figure 2:
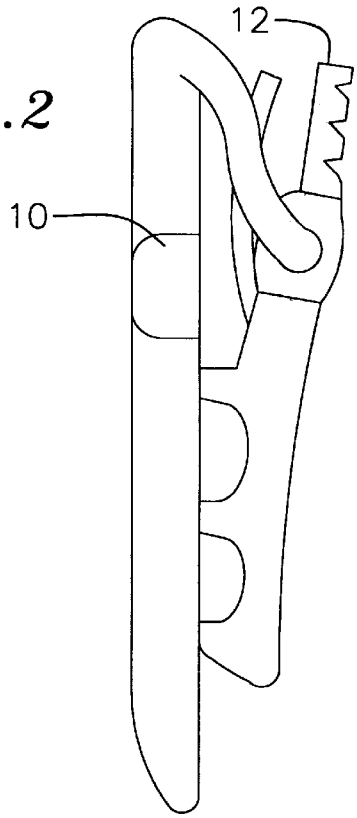
FIG. 2 is a side view of the marker and clip of the embodiment of FIG. 1.
Figure 3:
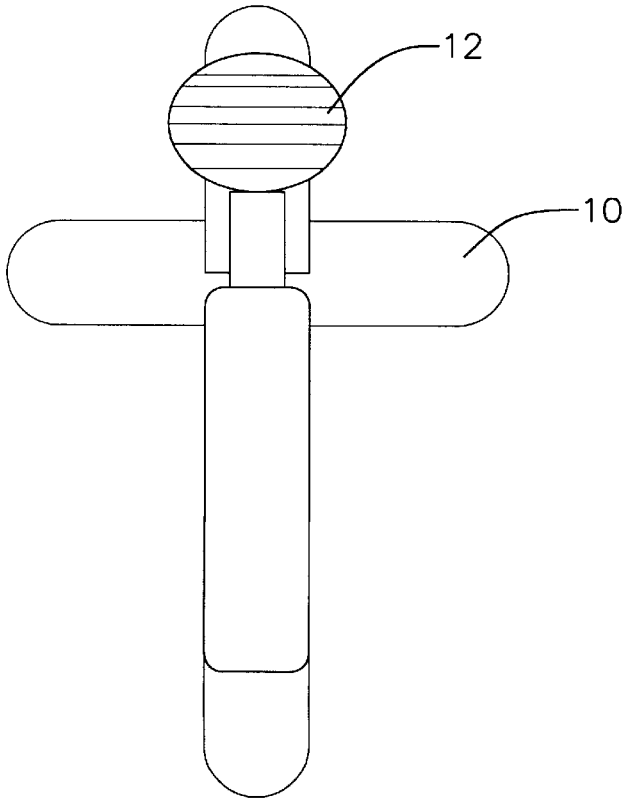
FIG. 3 is a rear view of the marker and clip of the embodiment of FIG. 1.
Figure 4:
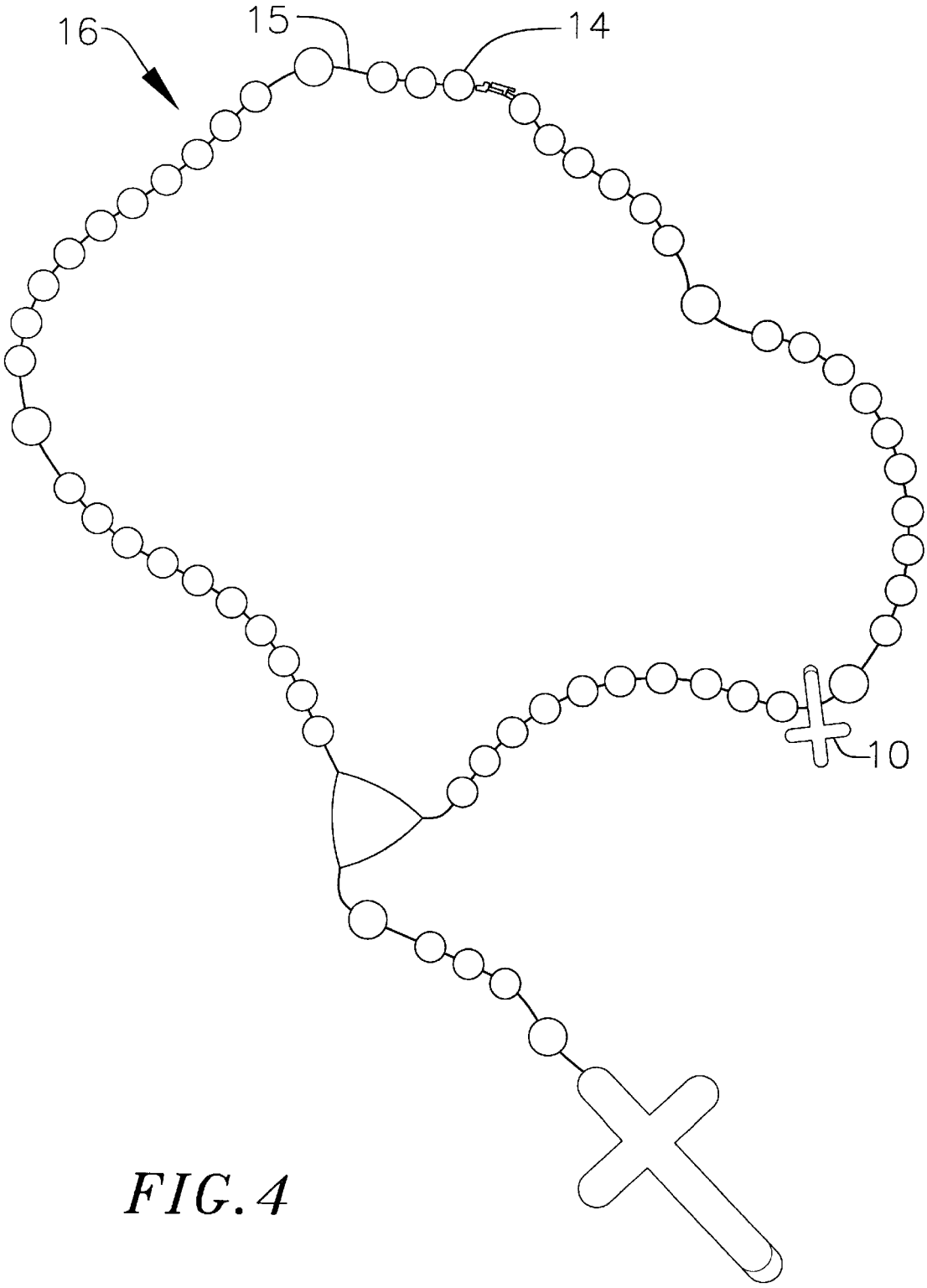
FIG. 4 is an elevated perspective view of the marker and clip of the embodiment of FIG. 1 in use on a prayer strand.

Reference is now made to the figures wherein like parts are referred to by like numerals throughout. As shown in FIG. 4, the present invention is used on a prayer strand 16 which includes a cord 15 having a plurality of nodes 14, such as knots or beads, disposed thereon for counting or otherwise tracking a sequence of prayers. With reference to FIGS. 1–3, the present invention comprises a marker 10 attached to a clip 12. The marker 10 may be attached to the clip 12 through welding, brazing, soldering, adhesives, mechanical fasteners, or the like. In an alternate embodiment, the clip 12 is integrally formed with the marker 10.

The marker 10 is formed into a shape that is visually and tactually distinguishable from the nodes 14 on a prayer strand 16. For example, the marker 10 may have a cruciform shape such as that shown in FIGS. 1–3. However, the marker 10 may be of any shape that distinguishes the marker 10 from the generally spherical nodes 14.

The clip 12 could take any form, but preferably has an open position and a closed position and preferably includes a spring to bias the clip 12 into the closed position. For example, the clip 12 could be an alligator clip known in the art. As shown in FIG. 4, the clip 12 engages the prayer strand 16 to secure the marker 10 to the prayer strand 16 or a node 14 thereon. Thus, the marker 10 may be used to mark and preserve a user's position along the prayer strand 16 for later reference as described hereinafter.

Figure 5:
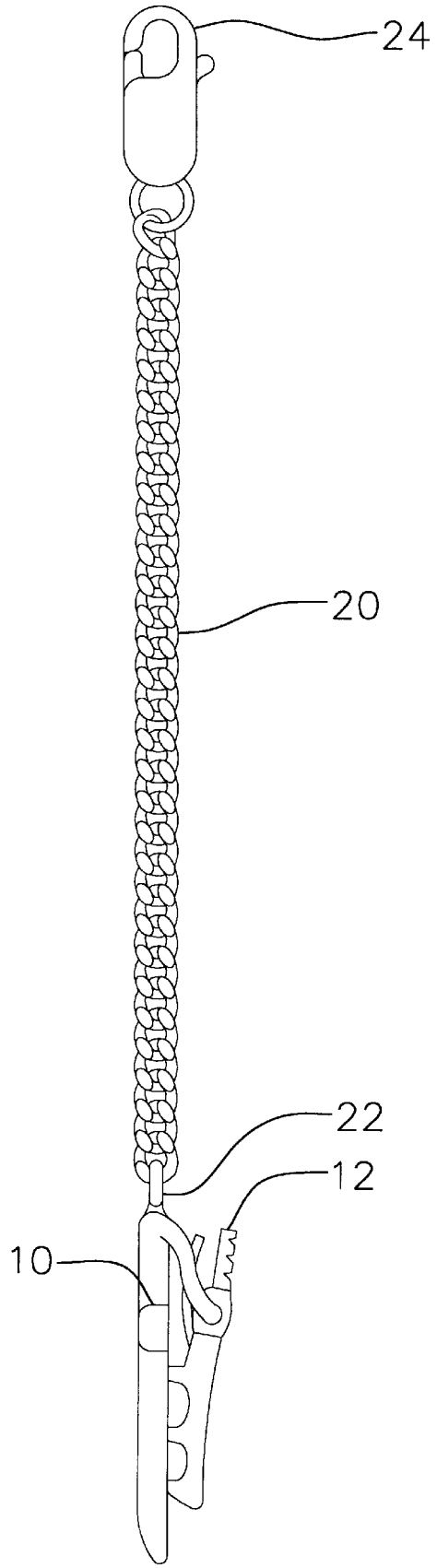
FIG. 5 is a side view of the marker and clip with a tether and clasp attached thereto according to an alternate embodiment of the present invention.

An alternate embodiment of the present invention, shown in FIG. 5, includes a tether 20 attached to the marker 10 at a first end of the tether 20. In a preferred embodiment, the tether 20 is formed from a flexible material such as string, chain, wire, line, or the like. In the embodiment of FIG. 5, the tether 20 is a chain which is attached to an eyelet 22 on the marker 10.

Figure 6:
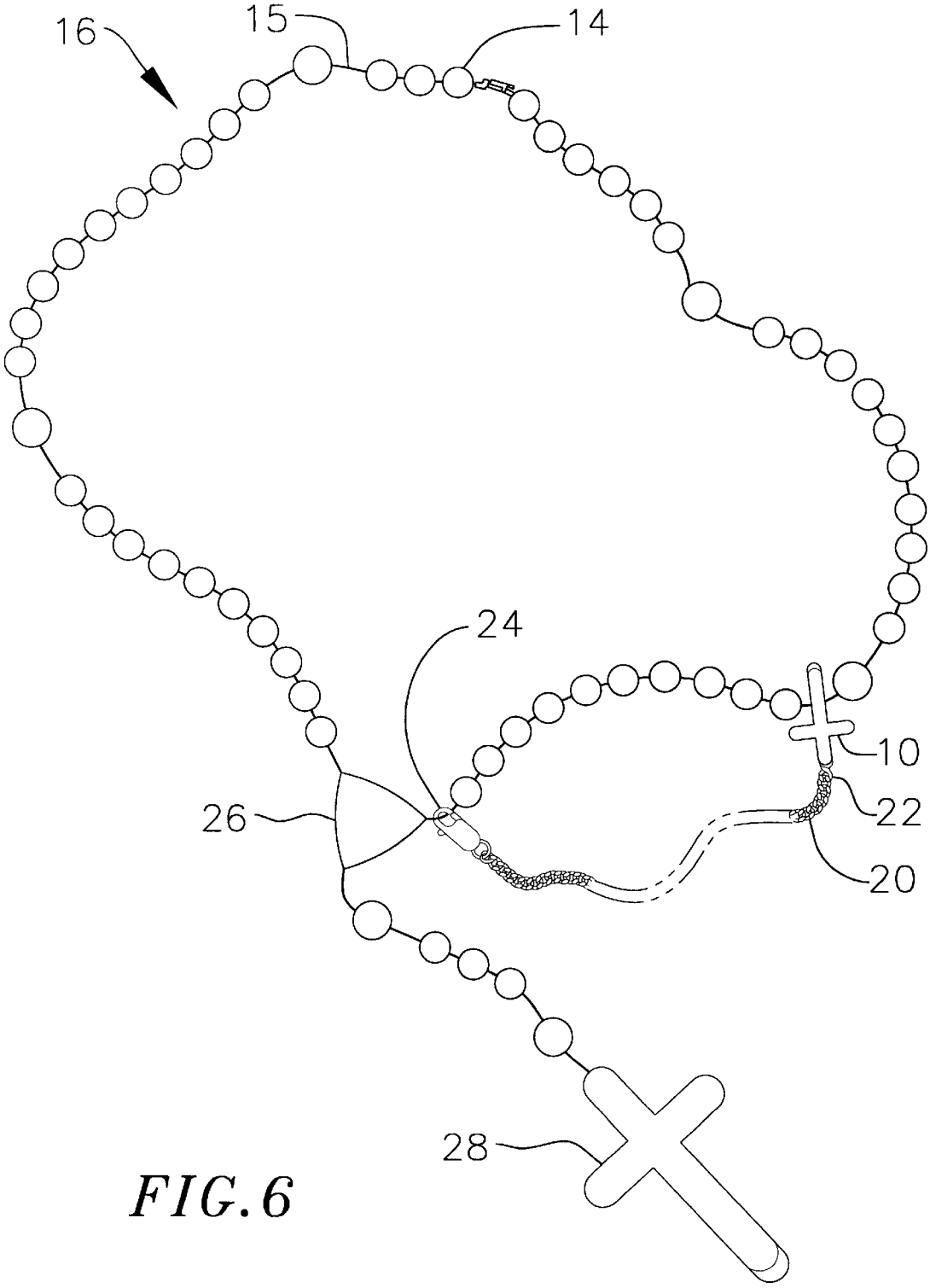
FIG. 6 is an elevated perspective view of the device of the embodiment of FIG. 5 in use on a prayer strand.

While the second end of the tether 20 could be free, in a preferred embodiment, a clasp 24 is disposed on the second end of the tether 20. The clasp 24 is adapted to engage the prayer strand 16 as shown in FIG. 6. Although the clasp 24 could be any type of clasp which is capable of engaging the prayer strand 16, in a preferred embodiment shown in FIG. 5, the clasp 24 is a spring-actuated jewelry clasp known in the art. Thus, as shown in FIG. 6, a user may secure the second end of the tether 20 to the prayer strand 16 to prevent the marker 10 and clip 12 from being separated from the prayer strand 16. Also, the clip 12 may be attached to clothing, a bag, or the like to allow the user to readily find the prayer strand 16. That is, a user could tether the prayer strand 16 to his or her clothing by merely attaching the clip 12 to his or her clothing. This can prevent the user from losing the prayer strand 16.

In use, the clasp 24 is attached to the cord 15 of a prayer strand 16 proximate the starting point on the prayer strand 16, as shown in FIG. 6. The location of the clasp 24 is preferably used to indicate the starting point of the prayer sequence as well as the direction of the in which the user is traversing the prayer strand 16. That is, as shown in FIG. 6, the location of the clasp 24 to the right of the bead 26 which is attached to the crucifix 28 indicates that the user was traversing the prayer strand 16 in a counter-clockwise direction. Conversely, the user could engage the clasp 24 to the left of the bead 26 to indicate that the user was traversing the prayer strand 16 in a clockwise direction.

With reference to FIGS. 4 and 6, in both embodiments, when a user wishes to mark the user's position on the prayer strand 16 during a recitation of a prayer sequence, such as when the user is interrupted or the like, the user opens the clip 12, secures the clip 12 to the prayer strand 16 at the point to be marked, and closes the clip 12. The marker 10 preserves and indicates the point of interruption. When the user wishes to resume, the user need only find the marker 10 by touch or sight and continue the prayer sequence from the point of interruption.

It is an advantage of the present device that it provides a tactually and visually perceptible marker 10 which may be secured to a prayer strand 16 to preserve, for later reference, a user's position along a prayer strand 16.

I claim:

1. A device for marking a position on a prayer strand used to count prayers, said prayer strand having a plurality of nodes positioned on a cord, comprising:

a visually and tactually perceptible marker;

a releasable clip attached to said marker for removably securing said marker to said prayer strand;

a tether having a first end connected to said clip and a second end; and a releasable clasp disposed proximate the second end of said tether to removably engage said prayer strand.

2. The device of claim 1 wherein said tether is flexible.

3. The device of claim 1 wherein said clip and said marker are integrally formed.

4. A device for counting a set of prayers, comprising:

a prayer strand having a plurality of spaced nodes positioned on a cord, each of said nodes representing an element of said prayer set;

a visually and tactually perceptible marker;

a releasable clip attached to said marker for removably securing said marker to said cord in the space between adjacent nodes;

a tether having a first end connected to said clip and a second end; and a clasp connected to the second end of said tether to engage said cord.

5. The device of claim 4, wherein said tether is flexible.

6. The device of claim 4, wherein said clip and said marker are integrally formed.

* * * * *